US005252364A

United States Patent [19]

Inoue et al.

[11] Patent Number: 5,252,364

[45] Date of Patent: Oct. 12, 1993

[54] METHOD FOR COATING AUTOMOTIVE VEHICLE BODIES

[75] Inventors: Hiroaki Inoue; Naoyuki Ikemizu, both of Hiroshima, Japan

[73] Assignee: Mazda Motor Corporation, Hiroshima, Japan

[21] Appl. No.: 824,188

[22] Filed: Jan. 22, 1992

[30] Foreign Application Priority Data

Jan. 22, 1991 [JP] Japan ..... 3-5771
Jan. 28, 1991 [JP] Japan ..... 3-8544
Jan. 30, 1991 [JP] Japan ..... 3-9680

[51] Int. Cl.[5] ..... B05D 1/36; B05D 1/02; B05B 15/04; B05B 13/02

[52] U.S. Cl. ..... 427/409; 427/424; 427/425; 118/301; 118/322; 118/324

[58] Field of Search ..... 427/409, 424, 425; 118/301, 322, 324

[56] References Cited

U.S. PATENT DOCUMENTS 4,968,530 11/1990 Yamane et al. ..... 427/409
4,988,537 1/1991 Tanimoto et al. ..... 427/409

*Primary Examiner*—Anthony McFarlane
*Assistant Examiner*—Nhat D. Phan
*Attorney, Agent, or Firm*—Fish & Richardson

[57] ABSTRACT

Disclosed is the method for coating automotive vehicle bodies, in which the upper vehicle body section and the floor member, constituting a vehicle body of the automotive vehicle, are conveyed simultaneously by the same conveying device at least up to the undercoating step for coating them with an undercoating paint. After the undercoating step, the floor member are separated from the upper vehicle body section at an appropriate timing, followed by separate conveyance to the following step.

23 Claims, 13 Drawing Sheets

METHOD FOR COATING AUTOMOTIVE VEHICLE BODIES

BACKGROUND OF THE INVENTION

1. Field of the Invention

The present invention relates to a method for coating automotive vehicle bodies and, more particularly, to a method for coating an automotive vehicle body with a floor member mounted to a reverse bottom surface of an upper vehicle body section.

2. Description of the Related Art

As disclosed in Japanese Patent Laid-open Publication (kokai) No. 61-163,297, automotive vehicle bodies with their floor member mounted and connected to a reverse bottom surface of their upper vehicle body section are conveyed in a coating line section of vehicle body assembly line by the aid of conveying means such as hanger conveyors or the like and immersed in a paint vessel, containing an electrodeposition paint, to form an undercoat, such as electrodeposited coat film, on the surfaces of the vehicle bodies. The vehicle bodies are then subjected to the formation of an undercoat member as a protective coat member with an undercoat member material on the reverse bottom surfaces of the floor members, as disclosed in Japanese Patent Laid-open Publication (kokai) No. 61-4,562.

In coating the vehicle bodies with an undercoating paint and with an undercoat member material in the coating line section of the vehicle body assembly line in such a state that their floor members are connected to the reverse bottom surfaces of the upper vehicle body sections, this arrangement suffers from the disadvantage that the upper vehicle body sections covering the top surfaces of the floor members may interfere with the operations for covering holes formed in the floor members with hole covers, for coating connections of panel members constituting the floor members with a sealer, and for setting a melt seal member on the top surfaces of the floor members.

It is considered, hence, that the operations required to be conducted prior to the conveyance into the coating line section, such as the operations for setting the hole coverings for the holes and so on, can be performed with ease by conveying the upper vehicle body sections and the floor members separately during the period of time when mountings including interior units, such as seats and interior trim members, are to be mounted to the vehicle bodies in a unit assembly step after the upper vehicle body sections and the floor members have been molded. The separate conveyance of the upper vehicle body sections and the floor members into the coating vessel containing the electrodeposition paint for undercoating presents the drawbacks that the coating operations become complex and coating costs become expensive.

SUMMARY OF THE INVENTION

The present invention has the object to solve the problems inherent in conventional coating methods and to provide a method for coating automotive vehicle bodies, in which the operations required to be conducted prior to conveyance into the coating line section can be implemented without making the coating operations complex.

In order to achieve the object of the present invention, the method for coating an automotive vehicle body composed of an upper vehicle body section and a floor member to be mounted to a lower bottom surface of the upper vehicle body section is characterized by:

conveying the upper vehicle body section and the floor member simultaneously through identical first conveying means at least up to completion of an undercoating step for coating the upper vehicle body section and the floor member with an undercoating paint; and separating the floor member from the first conveying means and conveying each of the upper vehicle body section and the floor member to a different step.

The arrangement for the method according to the present invention has the advantages that the paint vessel containing the undercoating paint can be made common, in which the upper vehicle body sections assembled with the floor members are immersed in the common undercoating paint vessel, thereby simplifying the coating operations and reducing the quantity of the paint to be carried over from the paint vessel in such a state that the paint is attached on the surfaces of the vehicle bodies. Further, the method according to the present invention allows the upper vehicle body sections and the floor members to be conveyed separately to the step, which follows, after the undercoating step, so that the operations can be implemented with ease, without being disturbed by the upper vehicle body sections to be otherwise mounted over the floor members, for mounting hole coverings on the holes formed in the floor members, for coating the connections of the panel members constituting the floor members with the sealer, for setting the melt seal members on the top surfaces of the floor members, and so on.

Other objects, features and advantages of the present invention will become apparent in the course of the description of the preferred embodiments, which follows, with reference to the accompanying drawings.

DESCRIPTION OF THE PREFERRED EMBODIMENTS

FIGS. 1-3

Figure 1:
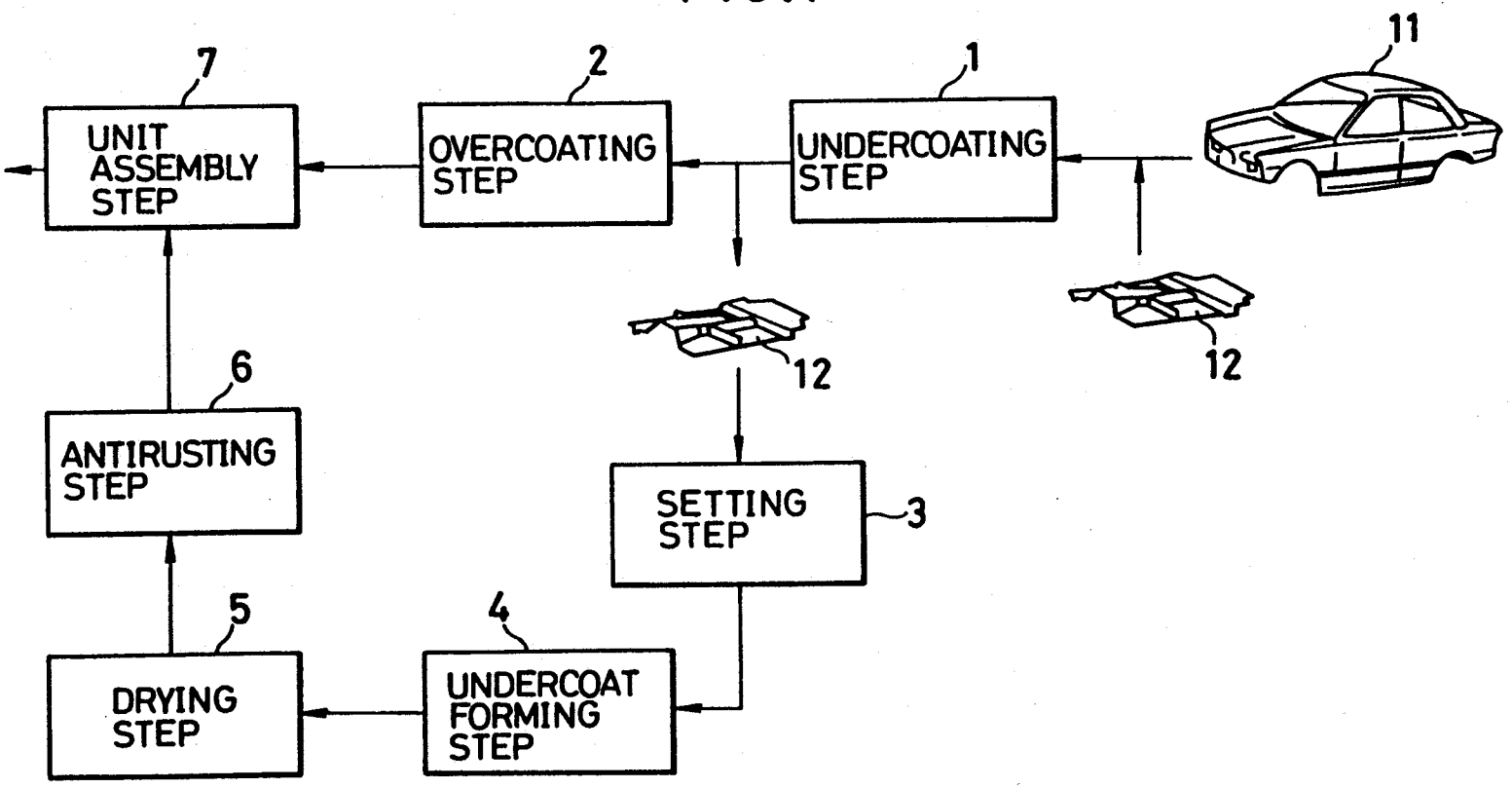
FIG. 1 is a block diagram showing the arrangement for the of the method according to an embodiment of the invention.

FIG. 1 shows an embodiment of the method according to the present invention. The coating method comprises an undercoating step 1 for treating the surfaces of vehicle bodies composed of the upper vehicle body sections 11 and the floor members 12 to be mounted to reverse bottom surfaces of the upper vehicle body sections and for coating the vehicle bodies with an electrodeposition paint, an overcoating step 2 for coating the upper vehicle body sections 11 with an intermediate coating paint and an overcoating paint, a setting step 3 for setting sealers, hole coverings, melt seal members and so on to the floor members 12, an undercoat forming step 4 for spraying the reverse bottom surfaces of the floor members 12 with an undercoat member material, a drying step 5 for drying the melt seal member and the undercoat member by heating the floor members 12, and an anti-rusting step 6 for coating an anti-rust agent for secondary purposes. Pairs of the upper vehicle body section 11 and the floor member 12 are held with the identical conveying means in the step prior to the undercoating step 1 and they are conveyed with the aid of the identical conveying means over the entire length of the undercoating step 1. The upper vehicle body section 11 and the floor member 12 are separated from each other and they are separated from the identical conveying means and conveyed separately to the steps which follow after the undercoating step 1.

Figure 2:
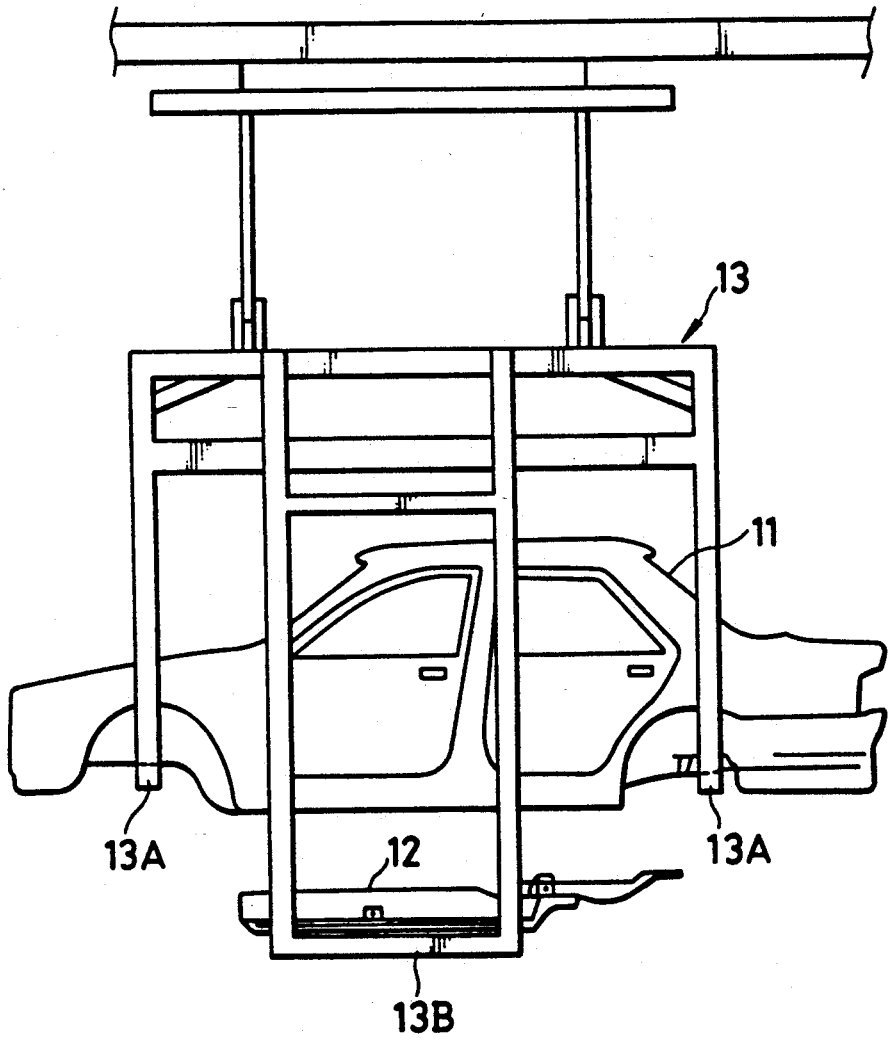
FIG. 2 is a side view showing an example of conveying means.
Figure 3:
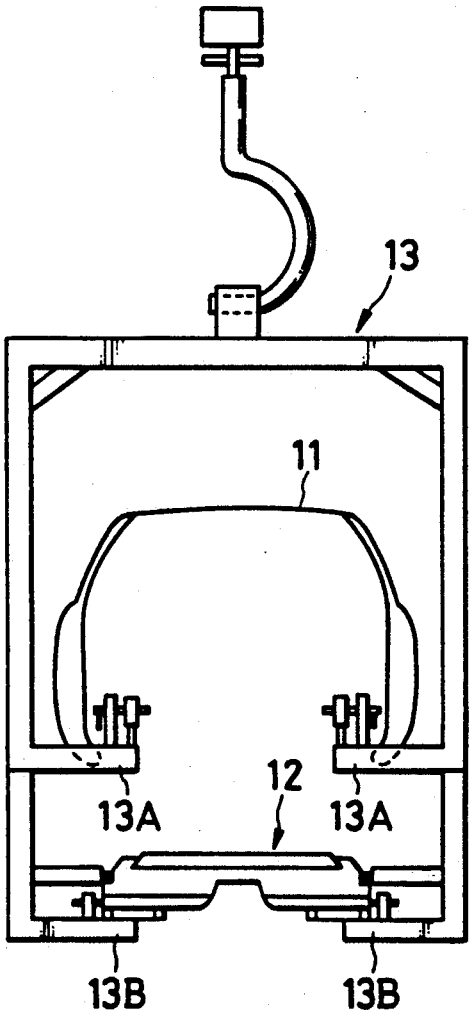
FIG. 3 is a front view showing the conveying means of FIG. 2.

More specifically, as shown in FIGS. 2 and 3, the upper vehicle body section 11 consisting of a roof panel, side panels, side sills and so on is held and supported at the upper portion of a conveying means 13, while the floor member 12 composed of the panel member to be mounted to the reverse bottom surface of the upper vehicle body section 11 is held and supported at a lower portion of the conveying means 13 in a predetermined distance apart from the upper vehicle body section 11. The upper vehicle body section 11 and the floor member 12 are conveyed simultaneously to the undercoating step 1 with the aid of the identical conveying means 13 in such a state that the upper vehicle body section 11 and the floor member 12 are held by the identical conveying means 13. At this end, the conveying means 13 comprises an upper supporting section 13A for supporting the side sills of the upper vehicle body section 11 and a lower supporting section 13B for supporting the reverse bottom surface of the floor member 12 at the position below the upper vehicle body section 11. The pair of the upper vehicle body section 11 and the floor member 12 in this juxtaposed state are first immersed in a surfacetreating vessel containing a surface-treating solution, thereby forming a zinc phosphate coat film on the surfaces of the upper vehicle body section 11 and the floor member 12. They are then conveyed with the aid of the identical conveying means 13 to the coating paint vessel and immersed therein for forming a coat film of the electrodeposition paint. The upper vehicle body section 11 and the floor member 12 are then withdrawn from the coating paint vessel in the undercoating step 1 and only the floor member 12 is removed from the conveying means 13 and then transferred to another conveying means (not shown) exclusive for the floor members. The floor member 12 is then conveyed with the aid of the exclusive conveying means to the setting step 3. After the setting step 3, the floor member 12 is processed in the undercoat forming step 4 for forming an undercoat member on the reverse bottom surface thereof and then conveyed to the unit assembly step 7 in which various parts, units and accessories are mounted to the floor member 12.

On the other hand, the upper vehicle body section 11 is then conveyed with the aid of the identical conveying means 13 to the overcoating step 2 for coating it with the intermediate coating paint and the overcoating paint. After the upper vehicle body section 11 has been processed with a sealer or an undercoat member layer has been formed thereon, as desired, it is conveyed to the unit assembly step 7 for mounting interior units, parts or accessories to the upper vehicle body section 11. After the interior units, parts and accessories have been mounted thereto in the unit assembly step 7, then the upper vehicle body section 11 is integrally assembled with the floor member 12 which in turn has been mounted with the various parts, units and accessories in the unit assembly step 7.

As described hereinabove, the upper vehicle body sections 11 and the floor members 12 are conveyed simultaneously to the undercoating step 1 with the aid of the same conveying means 13 and they were immersed in the surface-treating vessel containing the surface-treating solution and in the coating paint vessel in the undercoating step 1, respectively. Hence, no duplicate investment is required for the surfacetreating vessel and for the coating paint vessel for processing and coating the upper vehicle body sections 11 and the floor members 12 separately, thereby saving the costs of investment for equipment and reducing the quantities of the surface-treating solution and the coating paint to be carried over from the respective vessels with the solution and the paint stuck to the surfaces of the upper vehicle body sections 11 and the floor members 12. After the completion of the undercoating step 1, only the floor members 12 are removed from the conveying means 13 and transferred to the exclusive conveying means for conveying the floor members 12 to the following step separately from the upper vehicle body sections 11. Hence, the treatment of the floor members 12 separate from the upper vehicle body sections 11 allows the operations for covering the holes formed in the floor members 12 with hole covers in the setting step 3, for coating the connections of the panel members constituting the floor members 12 with the sealer, for setting the melt seal members on the upper surfaces of the floor members 12, and so on to be implemented without undergoing interference with the upper vehicle body sections 11.

The embodiment of the coating method according to the present invention presents the advantages that the mounting operations for mounting the inner trim members to the upper vehicle body sections 11, for mounting the seats to the floor members 12, and so on, can be implemented with ease because the upper vehicle body sections 11 and the floor members 12 are conveyed separately to the unit assembly steps 7.

FIG. 4

Figure 4:
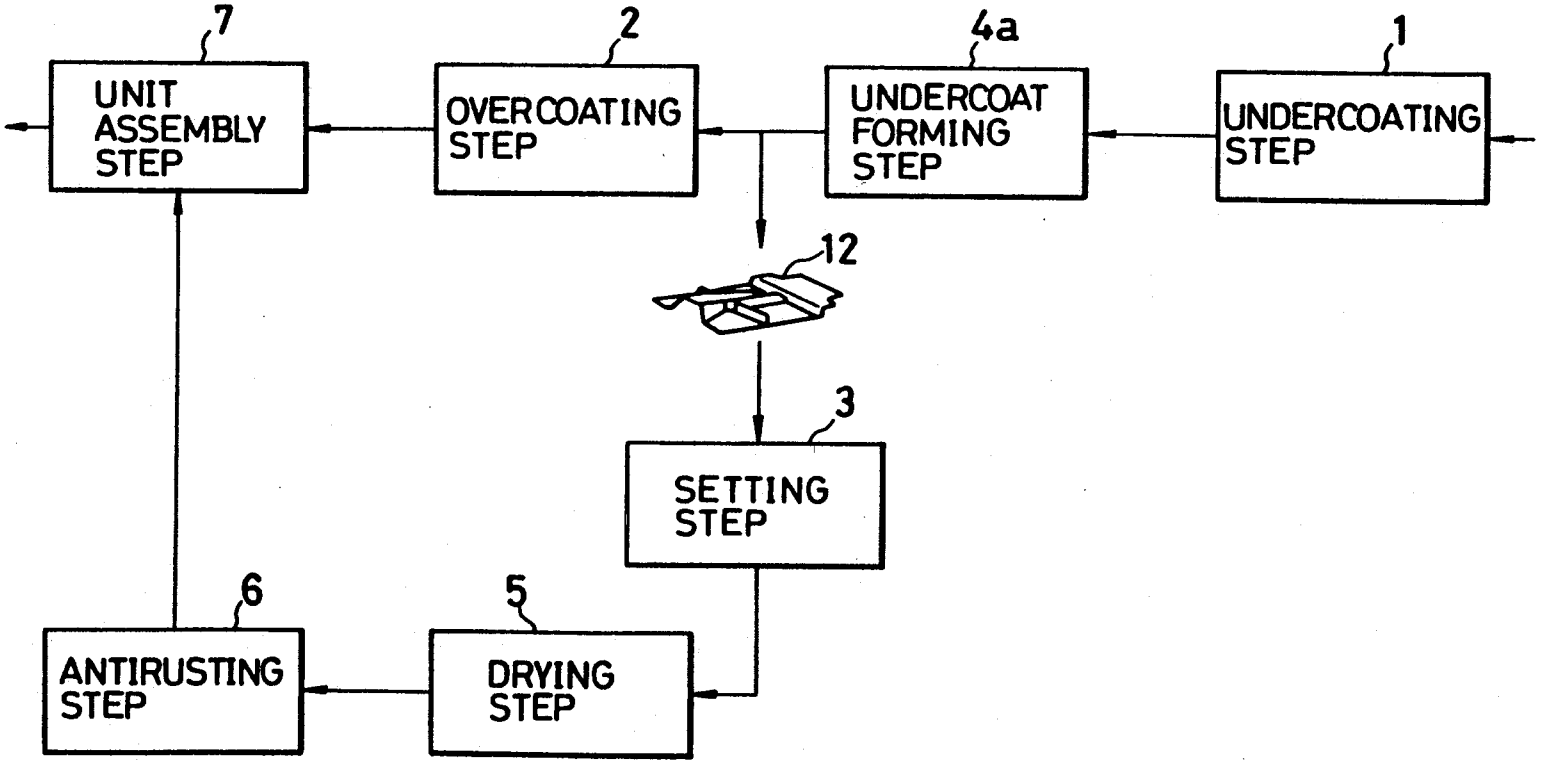
FIG. 4 is a block diagram showing the arrangement for the steps for the method according to another embodiment of the present invention.

FIG. 4 shows the arrangement for the steps of the method according to another embodiment of the present invention. This coating method involves conveying the upper vehicle body sections 11 and the floor members 12 simultaneously to the undercoating step 1 with the aid of the conveying means 13, forming an undercoat on the surfaces of the upper vehicle body sections 11 and the floor members 13 in the undercoating step 1, conveying the upper vehicle body sections 11 and the floor members 13 to the undercoat forming step 4a in such a state that pairs of the upper vehicle body sections 11 and the floor members 13 are supported and suspended by the identical conveying means 13, and spraying the reverse bottom surfaces of the floor members 12 with an undercoat member material in the undercoat forming step 4a. After the step 4a, the floor member 12 is separated and removed from the conveying means 13 with the upper vehicle body section 11 left mounted thereto, and transferred to the exclusive conveying means and conveyed to the setting step 3. On the other hand, the upper vehicle body section 11 is transferred to the overcoating step 2, which follows, and then to the unit assembly step 7 with the aid of the conveying means 13.

The floor members 12 are then conveyed from the setting step 3 to the drying step 5, followed by conveyance of the floor members 12 through the antirusting step 6 to the unit assembly step 7.

It is to be noted that the method according to the embodiment of the present invention is so arranged as to remove the floor members 12 only from the conveying means 13 after the floor members 12 and the upper vehicle body sections 11 have been coated with the undercoating paint in the undercoating step 1 and then treated for forming the undercoat member layer in the undercoat forming step 4a while they are supported by the identical conveying means 13. This arrangement for the method for coating the automotive vehicles can simplify the structure of the coating line and, further, perform with ease the operations for mounting the hole covers on the holes formed in the floor members 12 and the other operations required to be carried out in the setting step 3. The existence of the upper vehicle body sections 11 over the floor members 12 may generally disturb those operations.

It is noted that the method according to this embodiment of the present invention differs from the method as shown in FIG. 1 in that the undercoat forming step 4a is so arranged as to spray the floor member 12 with the undercoat member material, with the upper vehicle body section 11 supported over the floor member 12 by the same conveying means 13. On the other hand, the method as shown in FIG. 1 has the undercoat forming step 4a arranged so as to spray the floor member 12 removed from the conveying means 13 with the undercoat member material.

FIG. 5

Figure 5:
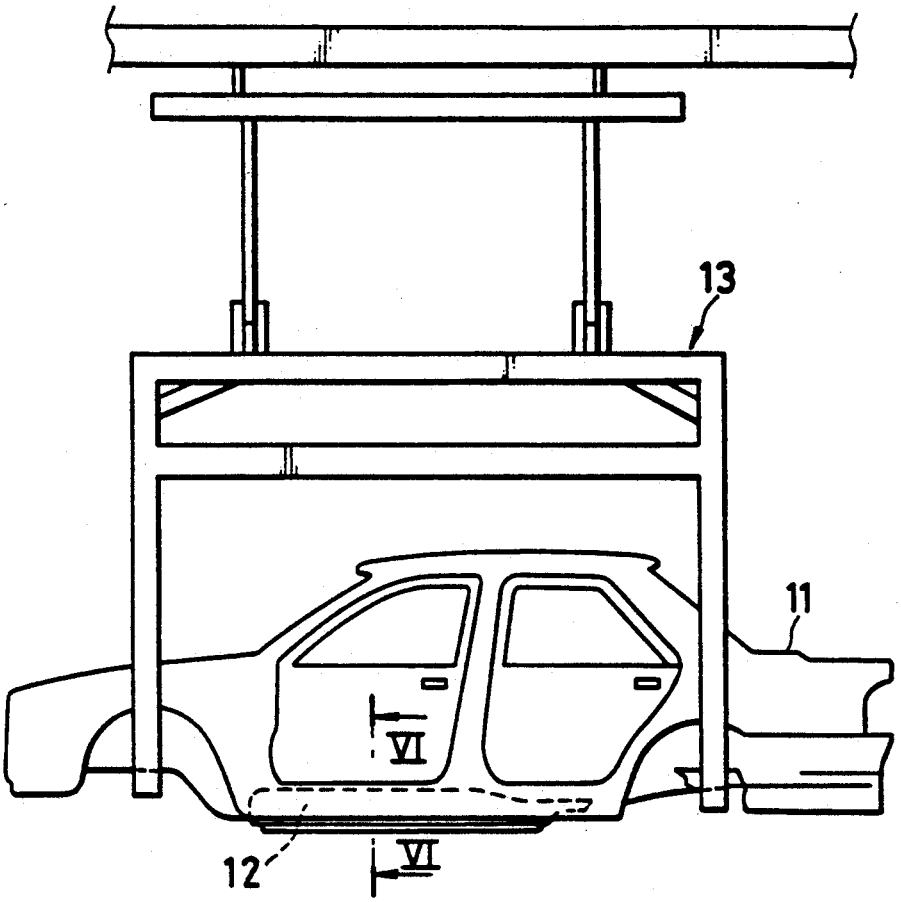
FIG. 5 is a side view showing another example of conveying means.
Figure 6:
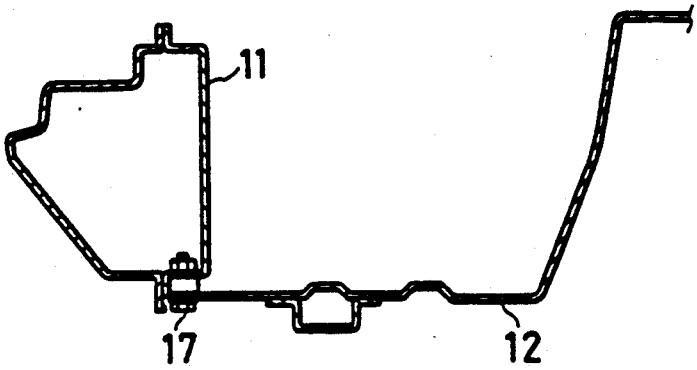
FIG. 6 sectional view taken along line VI—VI of FIG. 5.

FIG. 5 shows another example of the conveying means 13 to be employed for the method for coating the automotive vehicles. The conveying means 13 is composed of a hanger conveyor system which in turn is arranged so as to support the side portions of the upper vehicle body section 11, such as side sills, and the floor member 12 is temporarily fixed to the reverse bottom surface of the upper vehicle body section 11 with bolts and nuts 17 as shown in FIG. 6. Further, the upper vehicle body section 11 is conveyed together with the floor member 12.

When the upper vehicle body section 11 is subjected to the formation of the undercoat member layer in the undercoat forming step 4a in such a state that the floor member 12 is temporarily fixed to the reverse bottom surface of the upper vehicle body section 11, the floor member 12 mounted to the upper vehicle body section 11 serves as a mask for covering the lower inner surface of the upper vehicle body section 11 and prevents the mounting holes or their peripheral edges formed on the lower inner surface of the upper vehicle body section 11 from being clogged and blocked.

FIGS. 7 & 8

Figure 7:
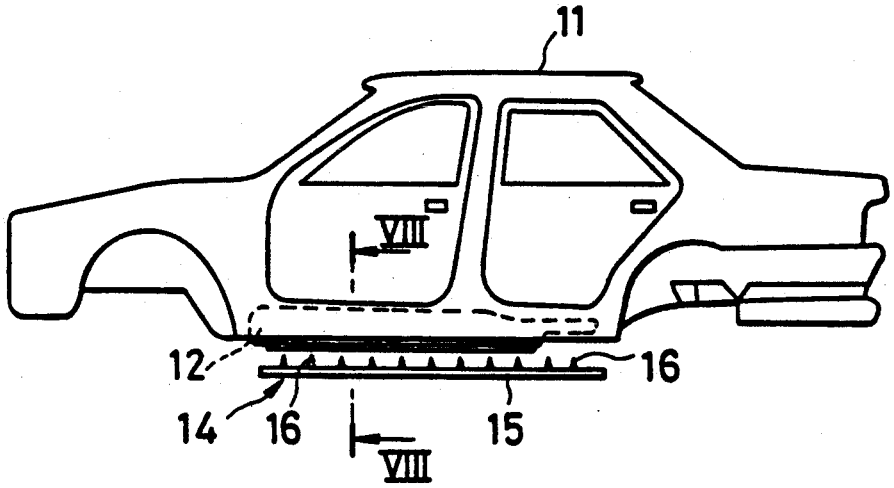
FIG. 7 is side view showing an example of a masking member with a temporarily mounting pin.
Figure 8:
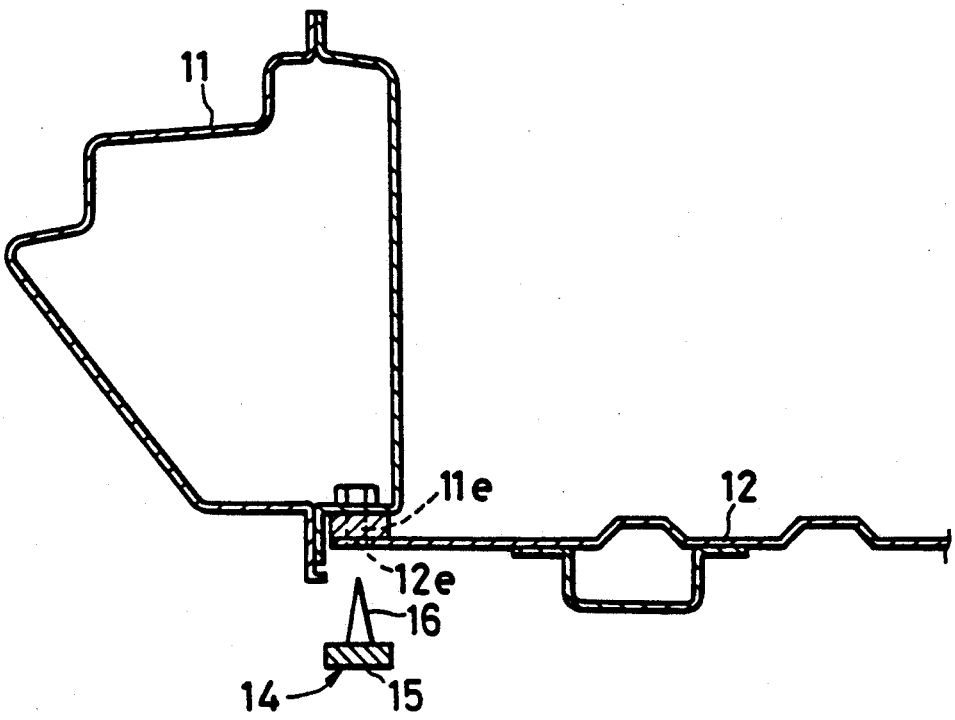
FIG. 8 is a sectional view taken along line VII—VII of FIG. 7.

FIGS. 7 and 8 show a preferred example of the masking member 14 to be employed for the method for coating the automotive vehicles according to the present invention. The masking member 14 comprises a base plate 15 for covering the reverse bottom surfaces of side portions of the floor member 12 and a plurality of upstanding pins 16 disposed on the upper surface of the base plate 15 so as to correspond to the mounting holes 11e and 12e formed in the upper vehicle body section 11 and the floor member 12, respectively, and so as to be inserted into the corresponding mounting holes 11e and 12e for temporarily fixing the floor member 12 to the lower surface of the upper vehicle body section 11. Further, the base plate 15 of the masking member 14 serves as covering the mounting holes 11e and 12e and their peripheral edge portions and the upstanding pins 16 formed on the base plate 15 thereof serves as preventing the undercoat member material from clogging or blocking them.

As shown specifically in FIG. 7, the base plate 15 of the masking member 14 is long enough to cover the positions of the plurality of the mounting holes 12e and 11e disposed in a spaced relationship apart in predetermined intervals, and the upstanding pins 16 are disposed on the base plate 15 so as to correspond to the number of the mounting holes 12e and 11e and the positions thereof. This arrangement for the masking member 14 can facilitate the operations for temporarily fixing the floor member 12 to the upper vehicle body section 11 because only one sheet of the masking member 14 is allowed to be mounted in one step, thereby blocking the plural mounting holes and at the same time temporarily fixing the floor member 12 to the upper vehicle body section 11.

As shown in FIG. 8, the upstanding pins 16 formed and disposed on the base plate 15 of the masking member 14 taper at their top ends, thereby allowing the upstanding pins 16 to be inserted into the mounting holes 12e and 11e and engaged tightly therewith and causing the floor member 12 to be temporarily fixed to the upper vehicle body section 11.

When the floor member 12 is temporarily fixed to the lower surface of the upper vehicle body section 11 with the aid of the masking member 14 having the aforesaid structure, laborious bolting operations can be omitted and as a consequence the coating method can be carried out with high efficiency as a whole. Further, the employment of the masking member 14 presents the advantage that the mounting holes 11a and 12a and their peripheral edge portions are prevented from being blocked or clogged with the undercoat member material to be sprayed in the undercoat forming step because the base plate 15 of the masking member 14 serves as covering the mounting holes 11*a* and 12*a* and the peripheral edge portions thereof.

FIG. 9

Figure 9:
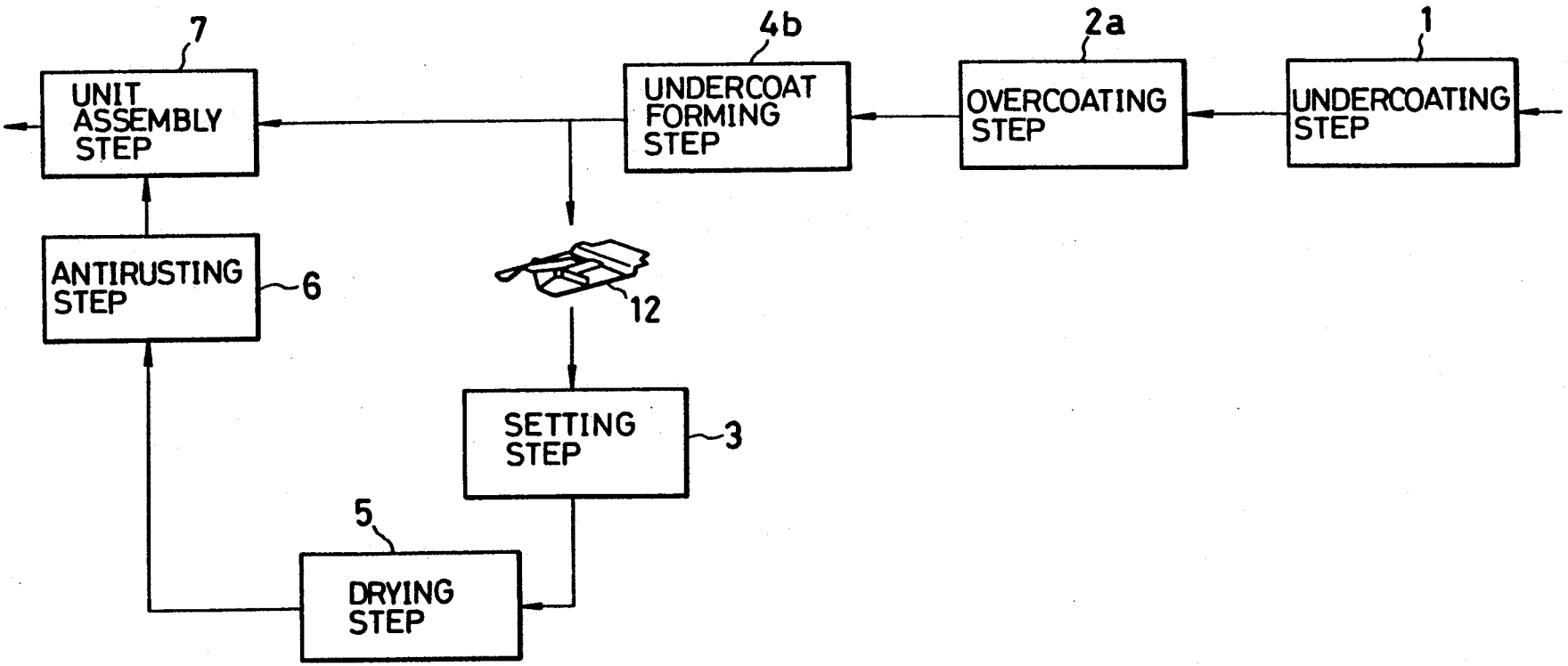
FIG. 9 is a block diagram showing the arrangement for the steps of the method according to a further embodiment of the present invention.

FIG. 9 shows the arrangement for the steps of the method according to a further embodiment of the present invention.

The method as shown in FIG. 9 involves conveying the upper vehicle body section 11 and the floor member 12 simultaneously in a suspended state by the identical conveying means 13 to the undercoating step 1, forming an undercoat on the upper vehicle body section 11 and the floor member 12 in the undercoating step 1, while they are supported by the identical conveying means 13, conveying the upper vehicle body section 11 and the floor member 12 in the suspended state through the identical conveying means 13 to the overcoating step 2*a*, forming an overcoat on the surfaces of the upper vehicle body section 11 and the floor member 12 in the overcoating step 2*a*, conveying them to the undercoat forming step 4*b* with the aid of the identical conveying means 13 for forming the undercoat member layer on the reverse bottom surface of the floor member 12, and removing the floor member 12 alone from the conveying means 13 and transferring it to the exclusive conveying means, and conveying the floor member 12 through the exclusive conveying means to the setting step 3.

When the method according to this embodiment of the present invention is so arranged as to form the undercoat member on the floor member 12 in the undercoat forming step 4*b* with the floor member 12 temporarily mounted to the lower portion of the upper vehicle body section 11 and thereafter the floor member 12 is removed from the conveying means 13 with the upper vehicle body section 11 suspended thereon, as described hereinabove, the configuration of the coating system for the method according to the present invention can be simplified and the operations for mounting the hole covers on the holes formed in the floor member 12 and the other operations required to be made in the setting step 3 are implemented with ease.

In addition, the method according to this embodiment of the present invention is arranged in such a manner that the upper vehicle body section 11 with the floor member 12 temporarily bolted to the lower portion thereof may be conveyed from the undercoating step 1 through the overcoating step 2*a* to the undercoat forming step 4*b* or that the upper vehicle body section 11 with the floor member 12 temporarily mounted to the lower portion thereof with the aid of the masking member 14 may be conveyed through the overcoating step 2*a* to the undercoat forming step 4*b* from the undercoating step 1.

FIGS. 10 & 11

Figure 10:
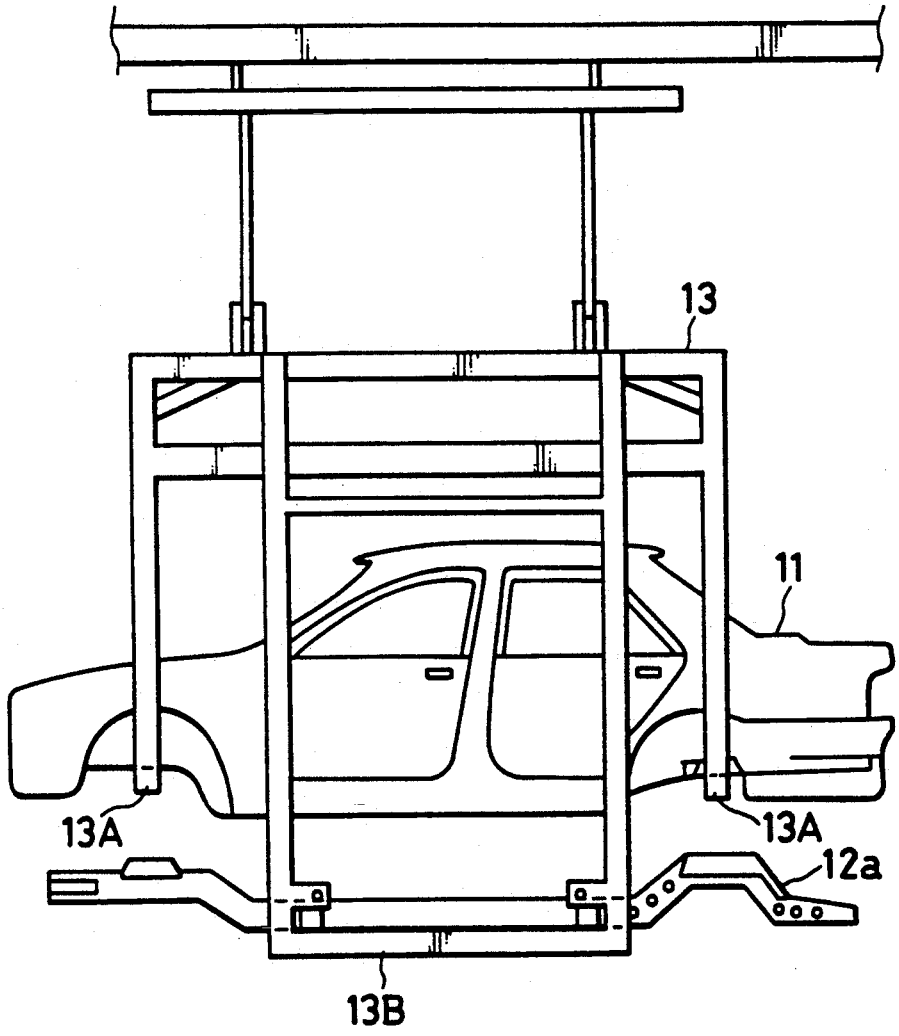
FIG. 10 is a side view showing another example of the floor member, which corresponds to FIG. 2.
Figure 11:
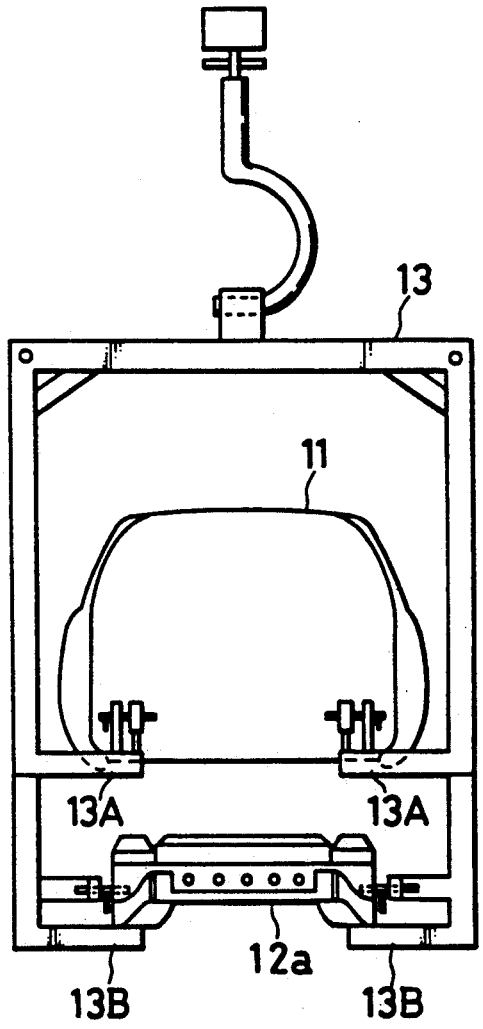
FIG. 11 is a front view of FIG. 10.

The aforesaid embodiments of the present invention are directed to the coating method which is applied to the vehicle bodies having the upper vehicle body sections 11 and the floor members 12 composed of the panel members, however, it is to be noted that they can also be applied to the vehicle bodies composed of the upper vehicle body sections 11 and floor members 12*a* composed of a frame member, as shown in FIGS. 10 and 11, and to other embodiments as will be described hereinafter.

Figure 12:
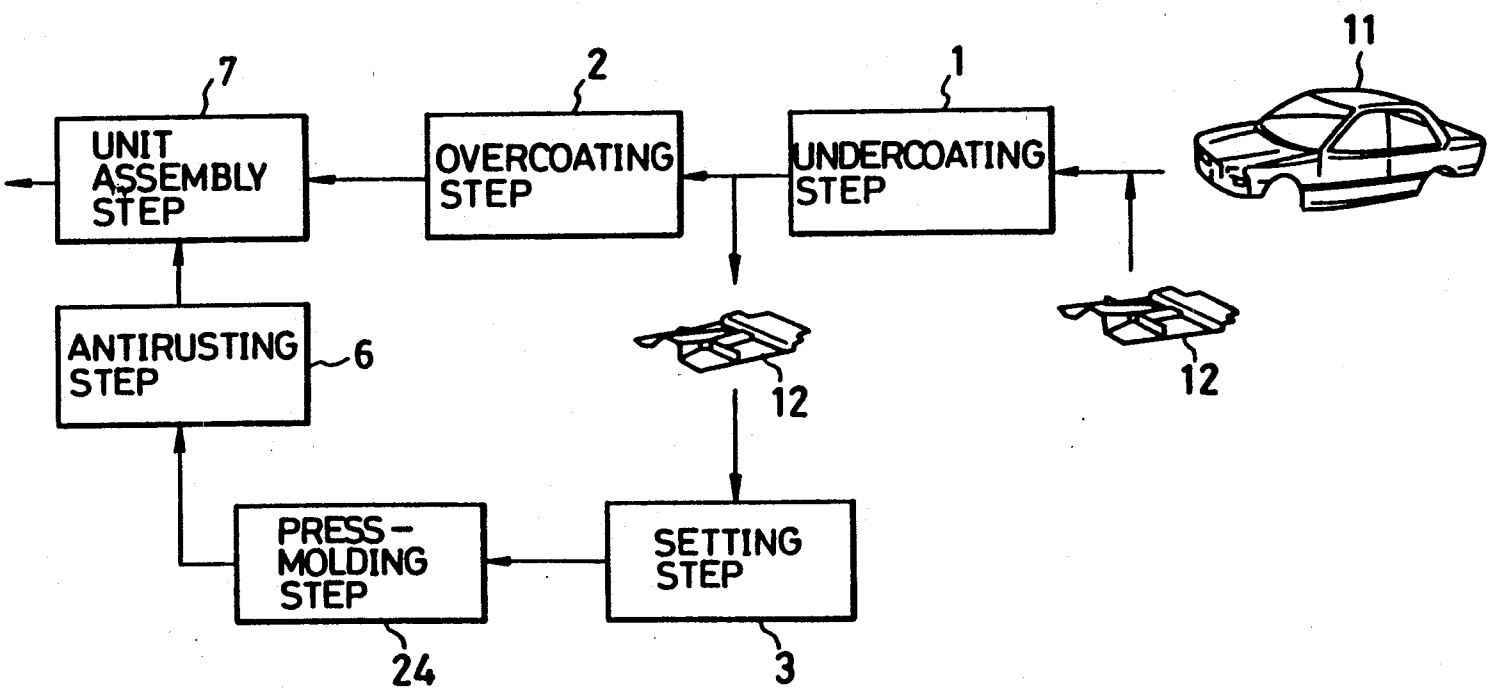
FIG. 12 is a block diagram showing the method according to a still further embodiment of the present invention.

FIGS. 12–14:

FIG. 12 shows the method according to a still further embodiment of the present invention. The process of this method has the press-molding step 24 disposed in place of the undercoat forming step 4 and the drying step 5 in the process of the method shown in FIG. 1.

Figure 13:
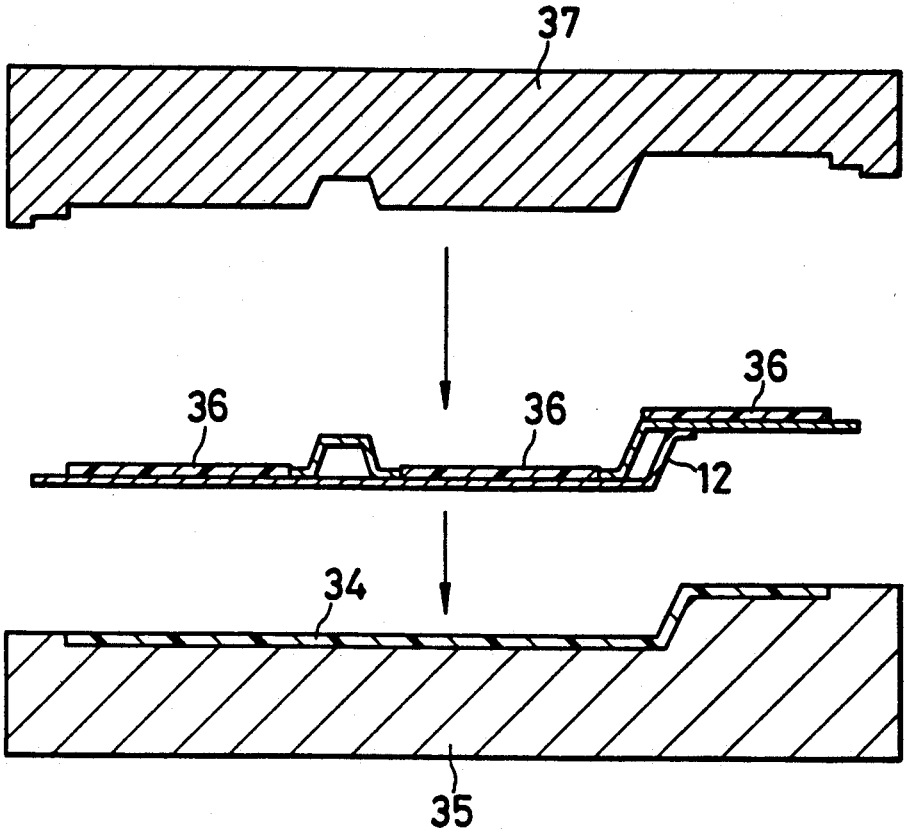
FIG. 13 is a sectional side view showing a press-molding step.

The upper vehicle body section 11 and the floor member 12 composed of the panel members are supported by the identical conveying means 13 and conveyed to the undercoating step 1 where they are coated with the undercoating paint. After the undercoating step 1, only the floor member 12 is removed from the common conveying means 13, transferred to the exclusive conveying means, and conveyed to the setting step 3. In the setting step 3, the hole covers are set on the holes formed on the floor member 12 composed of the panel members and a melt seal member is coated on the connections of the panel members and so on, followed by conveying the floor member 12 to the press-molding step 24. As shown in FIG. 13, in the press-molding step 24, a lower surface of the floor member 12 is coated with an undercoat member 34 composed of asphalt or a mixture of asphalt with a urethane resin member, or the like, and then set to a lower mold 35, and an upper surface of the floor member 12 is coated with a melt seal member 36 composed of asphalt or a mixture of asphalt with a urethane resin member, or the like, and set on the lower mold 35. Thereafter, an upper mold 37 is lowered to press the floor member 12 to thereby secure the undercoat member 34 and the melt seal member 36 to the floor member 12. The floor member 12 is then released from the pressmolding upper and lower molds 37 and 35, followed by conveyance to the anti-rusting step 6, where the floor member 12 is treated with an anti-rust oil, and then to the unit assembly step 7, where various parts, units and accessories are mounted to the floor member 12.

On the other hand, the upper vehicle body section 11 is conveyed to the overcoating step 2 from the undercoating step 1 with the aid of the conveying means 13 after the floor member 12 has been removed from the conveying means 13 subsequent to the undercoating step 1. In the overcoating step 2, the upper vehicle body section 11 is coated with the intermediate coating paint and the overcoating paint, followed by treatment with the seal member and the undercoat member, as needed. Then, the upper vehicle body section 11 is conveyed to the unit assembly step 6 where various parts, units and accessories are mounted to the upper vehicle body section 11 and it is then assembled integrally with the floor member 12 conveyed from the anti-rusting step 6.

For the method in this embodiment of the present invention, the upper vehicle body section 11 and the floor member 12 are supported by the same conveying means 13 and conveyed simultaneously to the undercoating step 1 where they are immersed in the vessel containing the surface-treating solution for treating the surfaces of the upper vehicle body section 11 and the floor member 12 and in the vessel containing the undercoating paint for forming an undercoat on the surfaces thereof. Hence, this coating method can make the configuration of the coating system simpler than the conventional coating method that requires separate surface-treating vessels and undercoating paint vessels for each of the upper vehicle body section 11 and the floor member 12. Further, considerable quantities of the surface-treating solution and the undercoating paint to be carried over and caused to drop outside the corresponding vessels can be reduced, thereby saving the quantities of the surface-treating solution and the undercoating paint and lowering costs for manufacturing automotive vehicles.

On the other hand, the floor member 12 is conveyed solely to the press-molding step 24 with the aid of the exclusive conveying means after it has been removed from the conveying means 13 common with the upper vehicle body section 11 and transferred to the exclusive conveying means subsequent to the undercoating step 1. Hence, this method does not require such large-scale equipment as required in conventional coating methods for conveying the upper vehicle body section 11 with the floor member 12 mounted integrally thereto to a working area where working robots are disposed. This method serves as simplifying the configuration of the conveying means exclusive for carrying the floor members 12. Further, the undercoat member can be formed with ease on the plate surfaces of the floor member 12 by automating the operations for setting the floor member 12 on the press-molding lower mold 35 and for setting the floor member 12 on the press-molding upper mold 37.

For the coating method according to this embodiment of the present invention, the floor member 12 is conveyed solely to the setting step 3 after removal from the common conveying means 13 subsequent to the undercoating step 1, so that the operations for setting the hole covers on the holes formed in the floor member 12, for coating the melt seal member on the connections constituting the floor member 12, and so on, can be carried out with ease, without causing the upper vehicle body section 11 to disturb the operations for the floor member 12 as in the conventional case where the floor member 12 is joined to the upper vehicle body section 11. Further, as the upper vehicle body section 11 and the floor member 12 are separately conveyed to the unit assembly step 7, the various parts, units and accessories for the upper vehicle body section 11, such as a suspension, can easily be mounted to the upper vehicle body section 11 and the various parts, units and accessories for the floor member 12, such as seats, can easily be mounted to the floor member 12, separately from the upper vehicle body section 11, in the unit assembly step 6.

Figure 14:
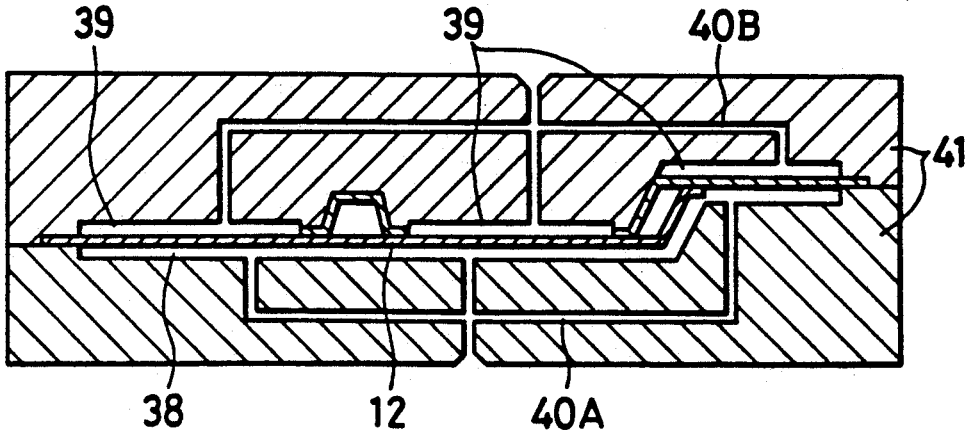
FIG. 14 is a sectional side view showing an injection molding mold for forming a protective layer for the floor member.

FIG. 14 shows an injection molding mold for forming a protective layer for the floor member 12. As shown in FIG. 14, the floor member 12 is set in a gap of a mold 41 composed of an upper mold and a lower mold. More specifically, the floor member 12 is placed within the gap composed of a filling portion 38 for forming an undercoat member layer and a filling portion 39 for forming a melt seal member layer. To the filling portion 38 is supplied the undercoat member material composed of asphalt or a mixture of asphalt with a urethane resin material, or the like, through a supply passage 40A disposed within the lower mold. On the other hand, the heat seat member consisting of asphalt, a mixture of asphalt with an urethane resin material or the like is supplied to the filling portion 39 through a supply passage 40B disposed within the upper mold. The arrangement for the mold 41 allows the undercoat member and the heat seat member layers to be formed on the corresponding surfaces of the floor member 12. In summary, the protective layers can be formed with ease by the automation of the procedures by using the injection molding step, in place of the press-molding step 24. Further, this system can form the protective layers on the floor member 12 with ease.

For the method according to this embodiment of the present invention, the protective layers composed of the undercoat member layer and the melt seal member layer are formed simultaneously on the both surfaces of the floor member 12. It is to be noted, however, that the upper and lower protective layers may be molded separately or either of the upper protective layer or the lower protective layer can be omitted. Further, the vehicle body panel to be joined to the upper vehicle body section 11 may include, for example, a floor panel, a fender panel and a trunk lid.

FIGS. 15 & 16

Figure 15:
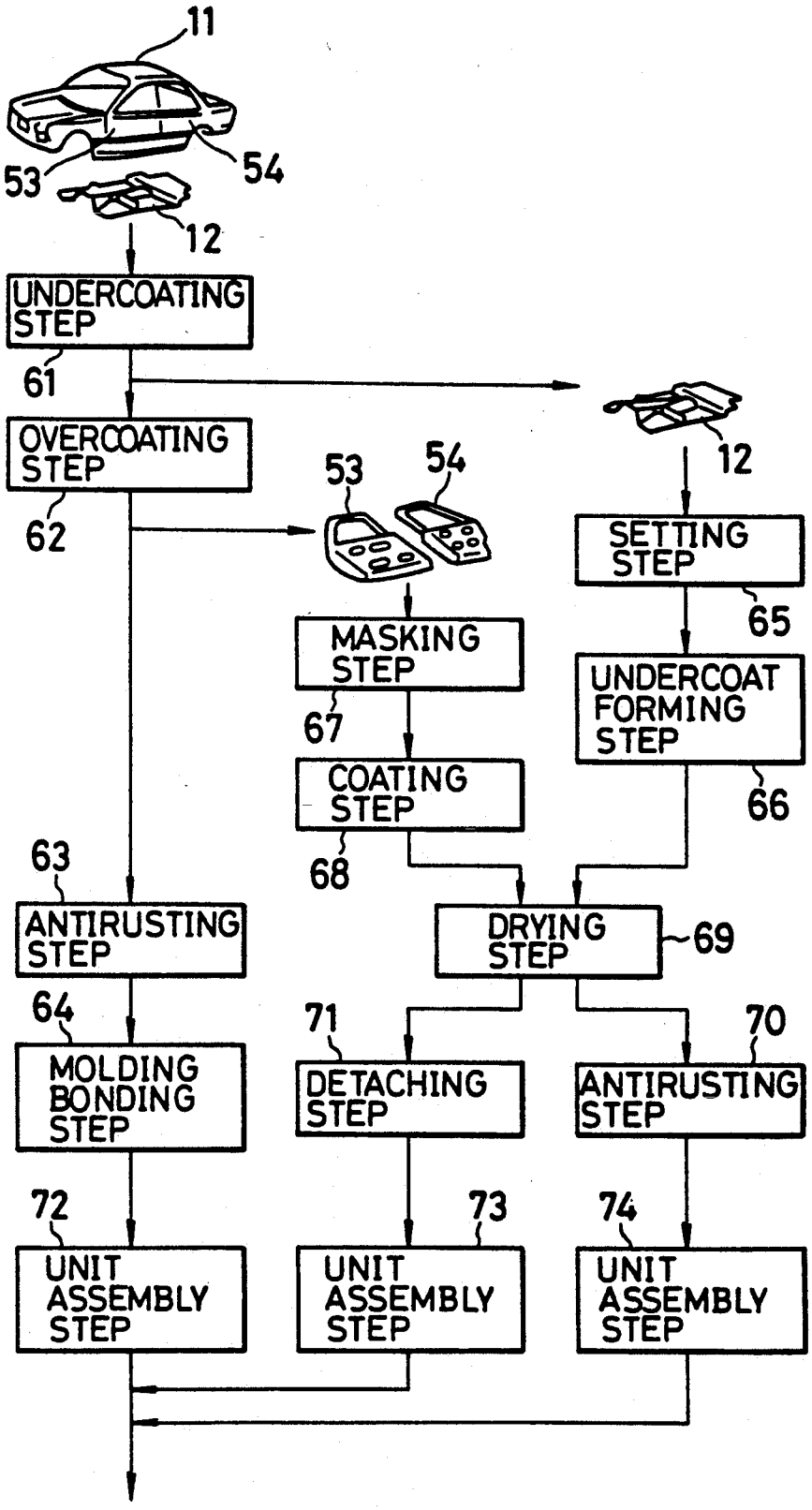
FIG. 15 is a block diagram showing the method according to another further embodiment of the present invention.

FIG. 15 shows the method according to another further embodiment of the present invention. This process is suitable particularly for partially coating an opening-closing member of the upper vehicle body section 11, such as side doors.

As shown in FIG. 15, the upper vehicle body section 11 is held and suspended in a predetermined vertical distance over the floor member 12 by the common conveying means 13 composed of a hanger conveyor, for example, as shown in FIGS. 2 and 3, and conveyed simultaneously to an undercoating step 61 with the aid of the conveying means 13 in such a state that front side doors 53 and rear side doors 54 are mounted to the corresponding sides of the upper vehicle body section 11. In the undercoating step 61, the vehicle body section composed mainly of the upper vehicle body section 11 and the floor member 12 is treated with the surface-treating solution and coated with the undercoating paint by immersing the upper vehicle body section 11 and the floor member 12 in a vessel containing the surface-treating solution and then in a vessel containing the undercoating electrodeposition paint. By immersing the vehicle body section in the surface-treating vessel, a zinc phosphate film or the like is formed on the surface of the vehicle body section, and an electrodeposited paint film is formed on the surface thereof by immersing the vehicle body section in the undercoating paint vessel. After the undercoating step 61, the floor member 12 only is removed from the common conveying means 13, on the one hand, followed by transferal to a conveying means exclusive for the floor member 12 and conveyance to a setting step 65.

On the other hand, the upper vehicle body section 11 with the front and rear side doors 53 and 54 mounted thereto is then conveyed through the conveying means 13 to an overcoating step 62 where it is coated with the intermediate coating paint and the overcoating paint, followed by removal of the front and rear side doors 53 and 54 from the upper vehicle body section 11 and conveyance to a masking step 67.

After the front and rear side doors 53 and 54 have been removed, the upper vehicle body section 11 is then conveyed to an anti-rusting step 63 with the aid of the conveying means 13, where the upper vehicle body section 11 is coated with an anti-rust oil, and thereafter to a molding bonding step 64 where a molding is bonded to the upper vehicle body section 11. The upper vehicle body section 11 is then conveyed to a unit assembly step 72 where various units, parts and accessories are mounted to the upper vehicle body section 11.

The floor member 12 removed from the common conveying means 13 subsequent to the undercoating step 61 is transferred to exclusive conveying means and conveyed to the setting step 65 where hole covers are set on holes formed in the floor member 12, a sealer is set on connections of the panel members constituting the floor member 12, and a melt seal member is sprayed on the top of the bottom surface of the floor member 12. The floor member 12 is then conveyed to an undercoat forming step 66 where an undercoat member material is sprayed on a reverse bottom surface of the floor member 12, followed by conveyance to a drying step 69 where the melt seal member layer and the undercoat member layer are heated to thereby bond them to the both surfaces of the floor member 12. Then, the floor member 12 is conveyed to an anti-rusting step 70 where it is coated with an anti-rust oil, followed by conveyance to a unit assembly step 74 where various parts, units and accessories are mounted to the floor member 12.

On the other hand, the upper vehicle body section 11 withdrawn from the undercoating step 61 and separated from the floor member 12 is conveyed through the conveying means 13 to the overcoating step 62 where it is coated with the intermediate coating paint and the overcoating paint, followed by processing the upper vehicle body section 11 with the sealer and by forming the undercoat member layer on the surface thereof, as needed. Then, the upper vehicle body section 11 is conveyed with the aid of the conveying means 13 to the anti-rusting step 63 where it is coated with the anti-rust oil. After the anti-rusting step 63, the upper vehicle body section 11 is conveyed to the molding bonding step 64 with the conveying means 13. In the molding bonding step 64, a molding is bonded to predetermined positions of the upper vehicle body section 11, followed by conveyance to a unit assembly step 72 where various units, parts and accessories are mounted to the upper vehicle body section 11.

Figure 16:
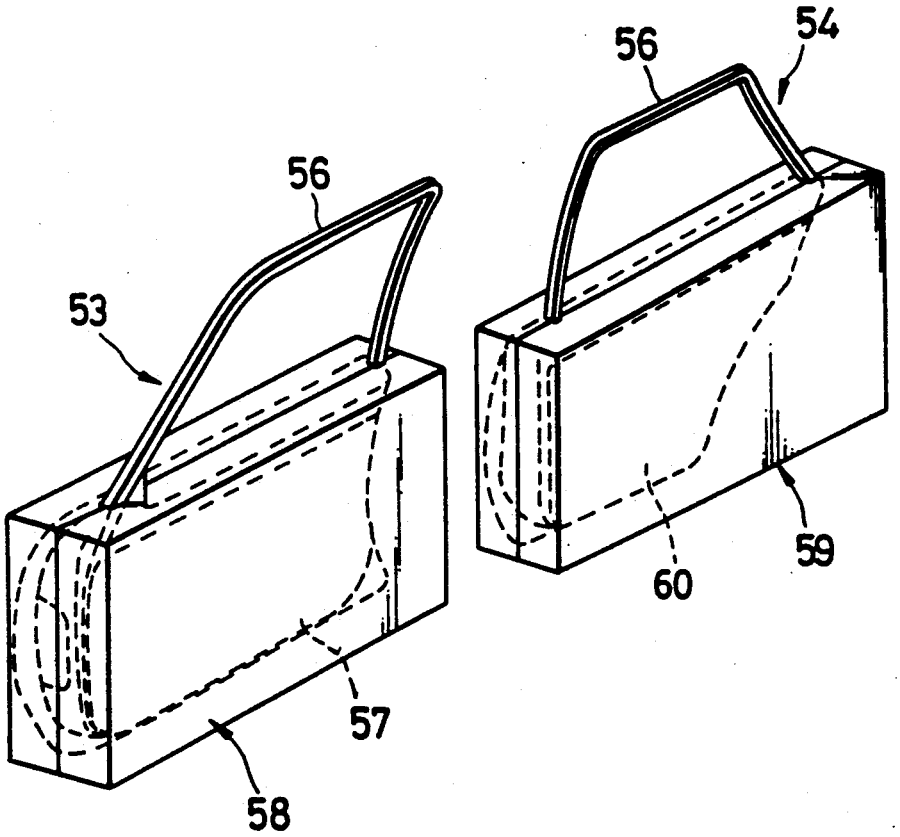
FIG. 16 perspective view showing masked doors as opening-closing members.

After the front and rear side doors 53 and 54 have been coated with the undercoating paint in the undercoating step 61 and then with the overcoating paint in the overcoating step 62 and removed from the upper vehicle body section 11 subsequent to the overcoating step 62, the front and rear side doors 53 and 54 are conveyed to the masking step 67 with an exclusive conveying means, although not shown in the drawings. In the masking step 67, as shown in FIG. 16, the front side door 53 is covered with a masking member 58 composed of a housing for covering a front side door body 57, except for a sash portion 56 thereof, and the rear side door 54 is covered with a masking member 59 composed of a housing for covering a rear side door body 60, except for a sash portion 56 thereof. Then, the front and rear side doors 53 and 54 are conveyed in the aforesaid state to a coating step 68 where their sash portions 56 are sprayed with a black paint, followed by conveyance to a drying step 69. In the drying step 69, the coat of the black paint formed on the surfaces of the sash portions 56 is cured by heating it at predetermined temperatures, and the front and rear side doors 53 and 54 are conveyed to a detaching step 71 where the masking members 58 and 59 are detached from the side door bodies 57, 60 of the front and rear side doors 53 and 54, respectively, followed by conveyance to a unit assembly step 73 where various units, parts and accessories are mounted to the front and rear side doors 53 and 54.

After the unit assembly steps 72, 73 and 74, the upper vehicle body section 11 is assembled integrally with the floor member 12 and the front and rear side doors 53 and 54.

As described hereinabove, the present invention can simplify the coating system composed of the conveying member as well as the surface-treating vessel and the undercoating paint vessel, as compared with the conventional coating system in which the components are treated and coated separately, because the coating method according to the present invention is arranged such that the upper vehicle body section 11 with the front and rear side doors 53 and 54 as well as the floor member 12 are conveyed simultaneously with the aid of the common conveying means 13 to the undercoating step 1 where the surface treatment is carried out by treating them with the surface-treating solution and they are coated with the undercoating paint.

Further, as described hereinabove, the coating method according to the present invention presents the advantages that a harmony in color can be ensured between the upper vehicle body section 11 and the front and rear side doors 53 and 54 as well as that equipment can be simplified and the coating time can be shortened, as compared with the coating of the side doors separate from the upper vehicle body section 11, because the front and rear side doors 53 and 54 are coated with the paint having a predetermined color in such a state that they are temporarily mounted to the upper vehicle body section 11.

In addition, the floor member 12 is removed from the common conveying means 13 and separated from the upper vehicle body section 11 subsequent to the undercoating step 1, so that it can readily be subjected to the operations in the setting step 65, without interference with the upper vehicle body section 11, for setting the hole covers on the holes formed in the floor member 12, for coating the connections of the panel members for the floor member 12 with the sealer, and for forming the heat seat member on the floor member 12.

Furthermore, the front and rear side doors 53 and 54 are conveyed with the aid of the exclusive conveying means to the masking step 67 after they have been separated from the upper vehicle body section 11, so that the masking members 58 and 59 can be mounted with ease and with accuracy, without interference with the upper vehicle body section 11. In addition, the black paint can be coated with high efficiency and with ease on the sash portions 56 of the front and rear side doors 53 and 54, because the remainder of the side doors is covered with the masking members 58 and 59 and, in other words, only the sash portions 56 are exposed from the masking members 58 and 59.

It is noted that the coating method according to the embodiment of the present invention is provided with the drying step 69 common with the floor member 12 removed from the common conveying means 13 and the front and rear side doors 53 and 54 removed from the upper vehicle body section 11, so that the structure of the drying equipment can be simplified and the area for the drying system can be minimized, as compared with the conventional system where the drying ovens are disposed separately for each of the floor members and the front and rear side doors.

It is further to be noted that the various units, parts and accessories, such as suspensions to be mounted to the upper vehicle body section 11 and the seats to be mounted to the floor member 12, can readily be mounted to the upper vehicle body section 11, the floor member 12 as well as the front and rear side doors 53 and 54, because they are conveyed separately to the respective unit assembly steps 72, 73 and 74.

In addition, it is to be noted that, although the aforesaid description has been made on the side doors, it can likewise be applied to the other openingclosing members such as a trunk lid, a bonnet and so on.

It is to be understood that the present invention is not construed as being restricted in any respects to those described hereinabove, which are described merely for illustrative purposes, and as encompassing all changes, variations, and modifications within the spirit and scope of the present invention.

What is claimed is:

1. A method for coating an automotive vehicle body composed of an upper vehicle body section and a floor member to be mounted to a lower bottom surface of the upper vehicle body section, comprising:

conveying the upper vehicle body section and the floor member simultaneously by means of a common conveying means at least up to completion of an undercoating step for coating the upper vehicle body section and the floor member with an undercoating paint; and separating the floor member from the conveying means and conveying each of the upper vehicle body section and the floor member to a different step.

2. A method as claimed in claim 1, further comprising:

a step of forming an undercoat member layer on a lower bottom surface of the floor member to be carried out subsequent to the undercoating step, wherein said step of conveying includes simultaneously conveying the upper vehicle body section and the floor member by the identical conveying means up to completion of said step of forming an undercoat member layer; and a step of separating the floor member from the conveying means following said step of forming an undercoat layer and conveying each of the upper vehicle body section and the floor member to a different step.

3. A method as claimed in claim 2, further comprising a step of temporarily mounting the floor member to the lower bottom surface of the upper vehicle body section.

4. A method as claimed in claim 3, wherein said step of temporarily mounting the floor member to the lower bottom surface of the upper vehicle body section includes using a bolt.

5. A method as claimed in claim 3, wherein said step of temporarily mounting the floor member to the lower bottom surface of the upper vehicle body section includes inserting a mounting pin into a first mounting hole formed in the upper vehicle body section and a second mounting hole formed in the floor member so as to correspond to the first mounting hole.

6. A method as claimed in claim 5, wherein said steps of inserting a mounting pin includes using a mounting pin with a masking member mounted integrally therewith; and further comprising a step of masking the second mounting hole and a peripheral area around the second mounting hole by the masking member in such a state that the mounting pin is inserted in each of the first mounting holes and the second mounting holes.

7. A method as claimed in claim 1, wherein said step of conveying includes simultaneously conveying the upper vehicle body section and the floor member by the conveying means in such a state that the upper vehicle body section is mounted in a spaced relationship apart from the floor member.

8. A method as claimed in claim 7, wherein said step of simultaneoulsy conveying the upper vehicle body section and the floor member by the identical conveying means in such a state that the floor member is supported by the conveying means below the upper vehicle body section.

9. A method as claimed in claim 1, further comprising a step of removing the floor member from the conveying means while the upper vehicle body section is supported by the conveying means.

10. A method as claimed in claim 1, further comprising:

a step of forming an overcoat subsequent to said step of undercoating;

a step of forming an undercoat member layer on a lower bottom surface of the floor member subsequent to said step of forming an overcoat, wherein said step of conveying includes simultaneoulsy conveying the upper vehicle body section and the floor member by the identical conveying means up to completion of the undercoat forming steps.

11. A method as claimed in claim 1, further comprising:

a step of press-molding the floor member;

a step of conveying the floor member to said step of press-molding after the floor member has been separated from the upper vehicle body section; and a step of forming a coat layer on a plate surface of the floor member by press-molding in said steps of press-molding.

12. A method as claimed in claim 11, wherein said step of forming a coat layer includes forming a melt seal member layer.

13. A method as claimed inc claim 11, wherein said step of forming a coat layer includes forming an undercoat member layer.

14. A method as claimed in claim 1, further comprising a step of forming a coat layer on a plate surface of the floor member by injection molding; and a step of conveying the floor member to said step of injection molding after the floor member has been separated from the upper vehicle body section.

15. A method as claimed in claim 14, wherein said step of forming a coat layer includes forming a melt seal member layer.

16. A method as claimed inc claim 14, wherein said step of forming a coat layer includes forming an undercoat member layer.

17. A method as claimed in claim 1, further comprising:

a step of coating the upper vehicle body section with an overcoating paint subsequent to said step of undercoating in such a state that an opening-closing member is mounted to the upper vehicle body section;

a step of detaching the opening-closing member from the upper vehicle body section; and a step of partially coating the openingclosing member.

18. A method as claimed inc claim 17, further comprising:

a step of separating the floor member from the upper vehicle body section prior to said step of overcoating;

a step of forming an undercoat member layer on a lower bottom surface of the floor member separated from the upper vehicle body section; and a step of conveying the floor member with the undercoat member layer formed thereon to a drying step for drying the undercoat member; and a step of conveying the opening-closing member partially coated to the drying step for drying a coat formed on the opening-closing member, the drying steps being common with the drying step for drying the undercoat member formed on the lower bottom surface of the floor member.

19. A method as claimed inc claim 17, wherein said step of partially coating the opening-closing member includes partially coating at least one of a door, a trunk lid or a bonnet.

20. A method as claimed in claim 1, further comprising:

a step of forming an overcoat subsequent to the undercoating step;

a step of separating the floor member from the upper vehicle body section prior to said step of forming an overcoat; and a step of conveying the floor member to an undercoat forming step for forming an undercoat member layer on a lower bottom surface of the floor member.

21. A method as claimed in claim 1, further comprising:

a step of setting a sealant and a hole cover on the floor member, wherein said step of setting the sealer and the hole cover on the floor member is done after the floor member has been separated from the upper vehicle body section.

22. A method as claimed in claim 1, wherein said step of conveying includes a hanger conveyor. is supported by the conveying means below the upper vehicle body section.

23. A method as claimed in claim 1, wherein said method includes using the floor member of a type where panel members are combined.

* * * * *